US005645113A

United States Patent [19]

Humm et al.

[11] Patent Number: 5,645,113

[45] Date of Patent: Jul. 8, 1997

[54] REFILLABLE DISTRIBUTING CONTAINER, FILLING DEVICE AND PROCESS FOR FILLING THE DISTRIBUTING CONTAINER

[75] Inventors: Siegfried Humm, Schoental-Westernhausen; Gabor Palosi, Oehringen-Buettelbronn; Bernd Weidner, Ingelfingen, all of Germany

[73] Assignee: Adolf Wurth GmbH & Co. KG, Kuenzelsau, Germany

[21] Appl. No.: 369,521

[22] Filed: Jan. 4, 1995

[30] Foreign Application Priority Data

Jan. 4, 1994 [DE] Germany ..... 44 00 062.6
Aug. 17, 1994 [DE] Germany ..... 44 29 161.2

[51] Int. Cl.[6] ..... B65B 1/04

[52] U.S. Cl. ..... 141/3; 141/20; 141/67; 141/192; 141/349; 141/367

[58] Field of Search ..... 141/113, 3, 20, 141/67, 98, 192, 193, 249, 291, 292, 296, 349, 351, 353, 354, 355, 356, 360, 361, 369, 386, 367; 222/334, 34; 137/209; 417/545, 552, 377, 392, 444, 443

[56] References Cited

U.S. PATENT DOCUMENTS

| | | | |
|---|---|---|---|
| 2,505,800 | 6/1950 | Smith | 226/93 |
| 2,684,805 | 7/1954 | McBean | 226/100 |
| 3,181,737 | 5/1965 | Chaucer | 141/349 |
| 3,211,191 | 10/1965 | Honisch | 141/20 |
| 3,422,837 | 1/1969 | Boyer et al. | 137/322 |
| 3,586,068 | 6/1971 | Nicholson | 141/20 |
| 3,601,164 | 8/1971 | Bruce | 222/334 |
| 4,321,953 | 3/1982 | Grothoff | 141/3 |
| 4,688,946 | 8/1987 | Latif et al. | 141/2 |
| 5,343,904 | 9/1994 | Kaeser | 141/20 |
| 5,375,632 | 12/1994 | Corona | 141/20 |

FOREIGN PATENT DOCUMENTS

| | | |
|---|---|---|
| 514803 | 7/1954 | Belgium . |
| 759957 | 5/1971 | Belgium . |
| 142346 | 5/1985 | European Pat. Off. . |
| 410947 | 1/1991 | European Pat. Off. . |
| 564421 | 10/1993 | European Pat. Off. . |
| 1898397 | 8/1964 | Germany . |
| 2010650 | 1/1971 | Germany . |
| 2540876 | 3/1977 | Germany . |
| 7726313 | 11/1977 | Germany . |
| 3307245 | 9/1984 | Germany . |
| 3445977 | 7/1985 | Germany . |
| 4002580 | 8/1991 | Germany . |
| 4226419 | 5/1993 | Germany . |
| 9300287.4 | 5/1993 | Germany . |
| 4334217 | 5/1994 | Germany . |
| 1111534 | 5/1968 | United Kingdom . |
| 2236146 | 3/1991 | United Kingdom . |
| WO 91/01257 | 2/1991 | WIPO . |
| WO-A-9304928 | 3/1993 | WIPO . |
| WO 94/03380 | 2/1994 | WIPO . |

*Primary Examiner*—Henry J. Recla
*Assistant Examiner*—Steven O. Douglas
*Attorney, Agent, or Firm*—Quarles & Brady

[57] ABSTRACT

A refillable distributing container for liquid media, particularly an aerosol can, has two valves, whereof an upper valve is constructed as the distributing valve (5) for exclusively distributing the container content. The second valve is constructed for filling the container both with liquid medium and with pressurized gas. The invention also relates to a filling device for refilling the distributing container and a process for the same. The filling device has a filling connection (9), which is connectable with the distributing container filling valve (8). The liquid is preferably forced in to the distributing container with the aid of the pressurized gas.

38 Claims, 4 Drawing Sheets

Figure 1:
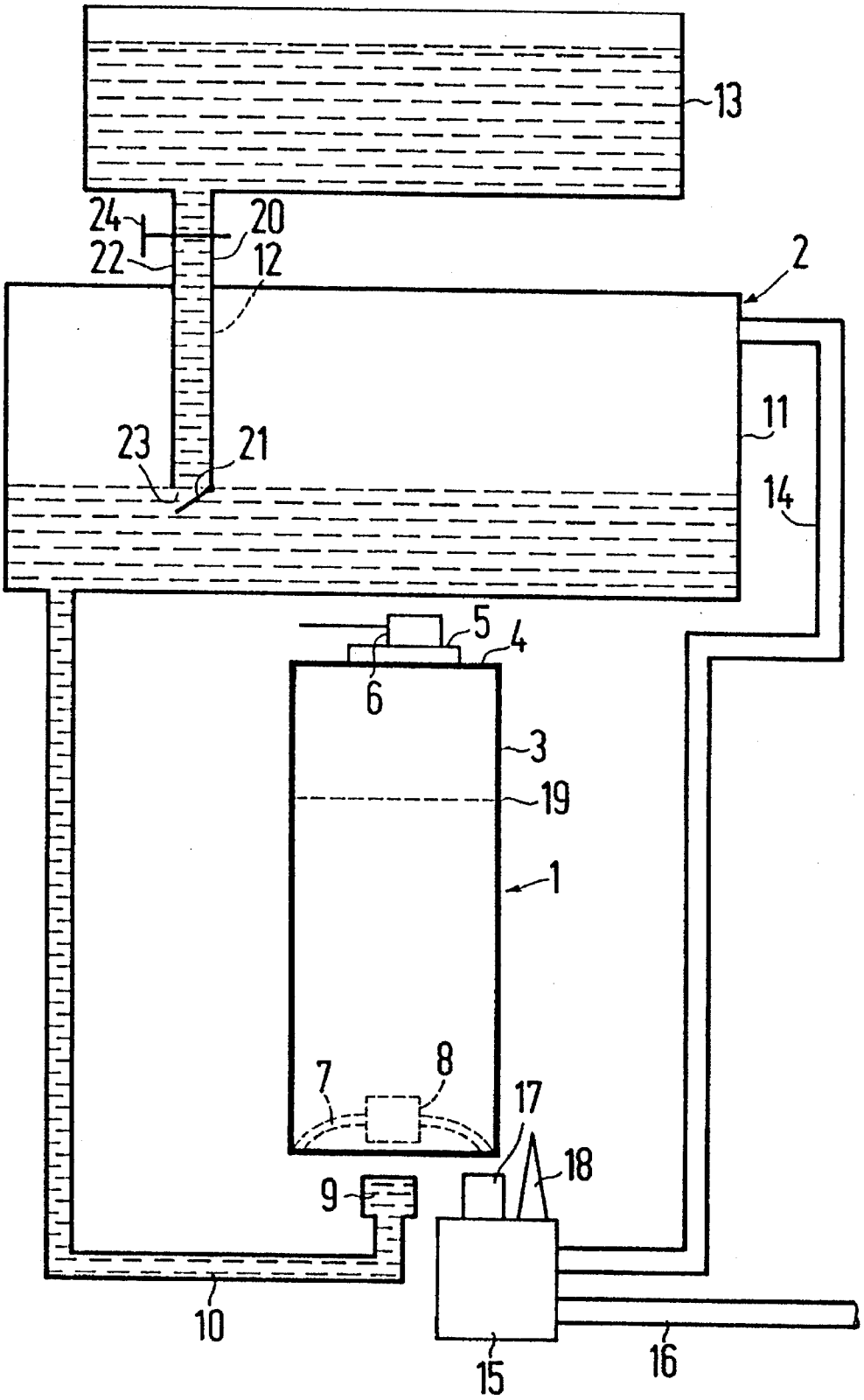

6"
1"
8"
9"
54
58
57
56
18"
61
55
13
53
44
41
11"
42
46
45
43
47
48
49
50
52
51
59
16
15"
17"
70

6'''
1'''
8'''
9'''
72
71
61
75
13
74
73
68
66
67
63
62
64
65
11'''
69
76
77
16'''
15'''
17'''
70

REFILLABLE DISTRIBUTING CONTAINER, FILLING DEVICE AND PROCESS FOR FILLING THE DISTRIBUTING CONTAINER

The invention relates to a refillable distributing or dispensing container for liquid media, particularly an aerosol can, in which an upper distributing valve is constructed exclusively for the distributing of the content, as well as a filling device for the same and a process for filling the distributing container.

Numerous containers for liquids, particularly spray and aerosol cans, are intended for a single use and following the discharge of the content are discarded. To avoid garbage the procedure has been adopted of using such containers a number of times, i.e. making them refillable. Thus, there are aerosol cans which can be refilled through their distributing valve, particularly in the case of a propellant-containing, liquid content, in which the propellant is dissolved in the liquid. However, such propellants should be avoided for environmental reasons. It is also known to provide on the top of aerosol cans a screw cap into which is incorporated the atomizing nozzle. After removing the screw cap the liquid can easily be refilled, so that following the sealing of the can an action by pressurized gas is possible. For this purpose cans are known having a further pressurized gas supply valve in the screw cap. Cans are also known having in the can bottom a valve for pressing in pressurized gas, particularly compressed air or nitrogen.

In industry the filling process is looked upon as a time-consuming operation and therefore represents an additional cost factor. In addition, leaks can occur if the screw cap becomes dirty and as a result there is a pressure loss, so that it is no longer possible to expel the can content.

It has also already been proposed to provide two valves on the bottom of aerosol cans, one being used for filling with liquid medium and the other for filling with pressurized gas.

The problem of the invention is to provide a distributing or dispensing container for liquid media, which permits a rapid and reliable refilling and in particular a filling device for the same, which permits at the point of use a rapid and problem-free refilling of the distributing container.

The distributing container according to the invention is characterized in that it has two valves and the second valve is constructed for filling the container both with liquid medium and also with pressurized gas. The filling valve independent of the container distributing valve can be adapted to the filling requirements, without simultaneously having to perform another function. Filling through a single valve permits rapid filling and a complication-free link with corresponding filling members.

The filling valve is advantageously located on the container bottom. It is appropriately constructed as a pressure valve, which is constructed by mounting the container on a filling connection of a filling device for the delivery of liquid medium and pressurized gas. The upper distributing valve is appropriately undetachably connected to the distributing container. In particular there is no need for screw caps and the like. Preferably, apart from the distributing valve and the filling valve, there is no need for further valves or openings on the container, so that the latter can be easily and inexpensively manufactured. The filling valve is appropriately centrally positioned on the container bottom, which is advantageously drawn in in concave manner, so that the valve does not project from the container base. The filling valve can be undetachably connected to the distributing container. However, it is advantageously replaceably connected to the container, so that if necessary the valve can be replaced.

It is particularly advantageous to construct a surface portion of the can, particularly the filling valve, as the operating member for a filling device control valve. Such a control valve, which can be constructed for starting up the filling process and/or for reloading the filling device, can be operated essentially simultaneously with the connection of the distributing container filling valve to the filling connection of the filling device. This helps further automation and acceleration of the filling process.

With particular advantage in the bottom region, particularly on the filling valve, the distributing container has a mechanical coding, which gives the nature of the medium to be filled and/or the distributing container volume. The mechanical coding can correspond with a corresponding coding on the filling device, particularly on its filling connection and/or control valve. Thus, only the correct distributing container can be filled, i.e. those distributing containers which are to be filled with a specific medium to be delivered by the filling device. The coding can also ensure that only containers with the correct volume are filled. Finally, as a result of the coding it is possible to exclude the filling of containers not appropriate for the filling system and in particular those unable to withstand the operating pressure. The coding can be formed by projections and/or recesses according to the male and female member or lock and key principle.

As a function of the liquid medium to be distributed or dispensed, the distributing container can have a capacity of a few milliliters to a few liters. As a rule the capacity is between approx. 0.2 liter and 1 liter. The liquid media to be distributed are advantageously those continuously required in industrial enterprises. They are in particular those media, which in the case of a prolonged interruption to the distributing process do not tend to clog the distributing valve or the distributing nozzle. These in particular include lubricants, cleaning agents, cosmetics, etc.

The invention also relates to a filling device for refilling the distributing container, particularly spray cans, with liquid medium and pressurized gas. This filling device is characterized by a dosing container constructed as a pressure container for receiving a liquid medium, a liquid line, which leads from the bottom or outlet of the dosing container to a filling connection constructed as a valve and which is connectable to a filling valve of the distributing container, optionally a dosing device for the in particular discontinuous resupply (of predetermined) liquid quantities to the dosing container and a pressurized gas device connectable with the dosing container for forcing liquid quantities out of the dosing container and into the distributing container and for building up a pressurized gas cushion in the distributing container.

In order to ensure that there is no unintentional filling of a distributing container intended for receiving another liquid medium, and/or a size intended for receiving another liquid volume compared with that set on the dosing chamber, the distributing container and the filling device can in particular have mechanical fits, which are matched to one another and only permit a connection of the distributing container and filling device, particularly the filling connection and filling valve of the distributing container, if the nature and quantity of the liquid medium in the filling device and distributing container coincide. Thus, fits can sense the diameter of the container to be filled for establishing the container or can size. Fits for detecting the correct can content can in particular be provided by a corresponding shape and size design of the distributing connecting piece and filling valve.

In an embodiment of the invention the filling device has a dosing container or chamber, which is set up for the delivery of a predetermined liquid medium quantity. When required, i.e. on initiating the filling process, this predetermined quantity is passed into the distributing container.

The dosing device of the filling device is preferably constructed according to an embodiment of the invention as a volume dosing device, which delivers a predetermined liquid volume to the dosing container or keeps it available there. In this embodiment the liquid volume in the dosing container generally corresponds to the liquid medium volume to be filled into the distributing container. The dosing device is advantageously settable or modifiable for changing the desired liquid quantity.

The valve of the filling connection of the filling device and the filling valve of the distributing container are advantageously constructed in such a way that they fit into one another and also operate one another with a correct association of the distributing container and filling medium and volume.

The filling connection valve is preferably a self-closing valve, which can be opened by pressing or mounting the filling valve of the distributing container. The distributing container filling valve can be constructed correspondingly. It is also possible to construct the filling valve as a pressure-dependent valve, which can be opened by fluid pressure, if the two valves are brought into engagement with one another and automatically closes again if there is a decrease in the pressure on the valve filling side. The two valves are advantageously engaged by merely pressing them together. It is also possible to use a coupling in the manner of a snap closure or bayonet catch, e.g. with locking by partial rotation.

The dosing container is constructed as a pressure container and is designed for the gas pressure used for filling the distributing container. This pressure is generally below 10 bar and normally approximately 6 bar. The pressurized gas device appropriately has a pressurized gas line issuing into the dosing container, particularly in the upper area thereof and which can be connected by means of a control valve to a pressurized gas source, e.g. a pump or a compressor or pressure container. The volume of the interior of the dosing container is advantageously greater than the maximum volume of the liquid quantity to be dosed or metered in. Thus, the dosing container has an additional capacity, which is used for forming a gas pressure cushion above the level of the liquid quantity. The gas pressure cushion above the liquid level serves to drive the liquid out of the dosing container and into the distributing container, without there being a significant or sudden pressure drop in the system. The gas quantity subsequently flowing out of the pressurized gas feed line is sufficient to maintain the pressure in the system.

It is possible to maintain the operating pressure in the dosing container and introduce under an overpressure into the dosing container the liquid volume intended for the next filling process. However, advantageously the area of the system or dosing container carrying the gas is connectable by means of a pressure compensating valve with the environment, the valve being in particular located in the gas feed line. By opening the pressure compensating valve at the end of the filling process the system can be brought to ambient pressure, so that a substantially pressureless refilling of the dosing container is possible. The operation of the control valve and preferably also the pressure compensating valve preferably takes place through the container to be filled during the installation and removal thereof. As the operation of the control valve and also that of the pressure compensating valve are performable alternatively, both valves are advantageously combined into a multiway, particularly a three-way valve, which has a common operating or actuating member.

The dosing device is appropriately constructed as a volume-dependent, volume dosing device, which on reaching a predetermined volume or filling level closes, the closure preferably reacting to pressure and remaining closed until there is a drop below the filling level and the pressure in the dosing container has decreased. The corresponding liquid quantity for the next filling process can flow substantially without pressure application from a liquid storage tank, whose content is preferably at ambient pressure.

The essential feature of the filling according to the invention is that liquid medium and pressurized gas are successively filled through the same valve and filling advantageously takes place without any interruption. This can advantageously be achieved in that a desired liquid volume is pressed in through the pressurized gas and the latter builds up the necessary pressure cushion in the distributing container.

The filling process according to the invention can be performed and terminated within a few seconds. The use of the distributing containers, particularly aerosol cans, is not impaired by the brevity of the filling operation. Therefore there is no need to keep in stock further distributing containers having the same capacity.

In an embodiment of the invention the filling device is constructed in such a way that firstly a predetermined liquid volume, which is preferably kept in a predetermined quantity in the dosing container, is forced out of the latter by the pressurized gas and dosed into the distributing container. The liquid volume is calculated in such a way that after the filling of the predetermined liquid volume in the distributing container there is still sufficient space to build up an adequate gas cushion through the subsequently flowing pressurized gas. If in the case of an incorrect emptying of the distributing container, i.e. when it is kept incorrectly, essentially only pressurized gas is discharged, so that remaining or significant liquid quantities are contained in a substantially pressureless manner in the distributing container, then the gas cushion can be built up again by subsequent filling exclusively with pressurized gas. For this purpose a separate pressurized gas delivery valve can be provided on the filling device. It is also possible to directly supply pressurized gas to the distributing connecting piece of the filling device by means of a pressurized gas line and an additional control valve.

In a preferred embodiment the dosing container is constructed as a pneumatic dosing pump. The liquid chamber and the gas chamber of the dosing container are preferably separated from one another by a movable, at least temporarily sealing partition, particularly a piston, which modifies the size of the air chamber and liquid chamber relative to one another. The partition is advantageously movable by the pressurized gas in the direction of the outlet or bottom of the dosing container, whilst reducing the size of the liquid chamber, and can preferably be reset by spring tension. In particular through the setting of the spring tension the dosing container can also be constructed as a suction pump, in order to suck the liquid quantity out of the storage tank. In this embodiment freedom exists regarding the arrangement of the storage tank. It can then also be positioned below the dosing container.

A mechanical switching member can be associated with the partition, particularly the piston and on reaching an end position, following the forcing out of the liquid volume, opens a control valve for the gas supply line for supplying compressed air into the distributing container. The control valve can also be located outside the dosing container. In a particularly preferred embodiment the control valve is located in the dosing container.

In the pressure line or filling line between the dosing container and the distributing valve is preferably provided a check valve, which prevents a return flow of liquid or gas from the line system, if there is a relative underpressure in the dosing container. In similar manner advantageously between the control valve for the pressurized gas and the distributing valve a check valve is provided, which prevents a return flow of liquid or gas if the gas pressure line is pressure-relieved.

In an embodiment of the invention the return flow of liquid or gas to the dosing container and gas line is prevented by a check valve, which is functionally located on the bottom or outlet of the dosing container or a line portion passing out of the same, before the line portion is subject to any optional branching. In this embodiment pressurized gas can flow through the dosing container. It is also appropriately possible for there to be a flow through the partition or piston and there can be a check valve acting in the flow direction functioning as a control valve for the pressurized gas and on reaching an end position following the delivery of the liquid volume is opened by the mechanical control element, so that the pressurized gas can flow through the pressure line between the dosing container and the distributing valve into the distributing container.

In an embodiment of the invention a gas vent line is provided, which introduces the gas released during gas pressure relief from the system into the storage tank, so as to prevent therein any entrained liquid droplets and mist and so as to condense vapours. Thus, the burden on the environment is kept low.

According to advantageous developments of the invention all the control and regulating devices and valves are not constructed electrically. The corresponding devices and valves are pneumatically, hydraulically and/or mechanically operable, which avoids the otherwise necessary explosion-protected construction of the filling installation.

The refilling line between the liquid storage tank and the dosing container is preferably passed in this embodiment through a removable lid in the storage tank, so that there can be a problem-free replacement of the tank, which is e.g. a plastic drum, without any replacement of the line connections. A gas return line and optionally further lines can also be passed through said lid into the storage tank.

In order to prevent an undesired penetration of air into the system when the storage tank is empty, in an embodiment there is a level-dependent stop valve, which reacts to the liquid level in the tank. For this purpose in the storage tank can be provided a level-dependent float valve constructed as a stop valve and which closes the liquid line passing out of the tank when the liquid level drops below a predetermined point. In order to shut down the entire system when the storage tank is empty, a master switch can be located in the compressed air supply line and is operable as a function of the liquid storage tank filling level and blocks the compressed air suppliable to the system on dropping below a predetermined liquid level. The storage tank can contain a float valve constructed as a control valve and which is connected by means of pressure lines to the master switch and which opens when the liquid level drops below a predetermined point, so that a pressure pulse is emitted which closes the master switch. The stop valve for the liquid line and the control valve for operating the master switch can be jointly integrated into a float valve, which performs both functions. This float valve can be removable with the lid, so that the liquid line and the master switch are in each case closed when the lid is removed.

In a preferred embodiment the lid has a coding or fit cooperating with the container and which differ as a function of the container volume and content, which avoids storage tanks of the incorrect size and/or content being incorrectly connected.

In another embodiment of the invention the filling device is constructed in such a way that firstly there is a filling of the distributing container with pressurized gas up to a partial pressure, after which liquid is forced into the distributing container until the predetermined maximum pressure is reached. In this case there is a pressure-dependent liquid dosing and not a volume dosing. As a result of this embodiment of the filling device and filling process it is ensured that there is always an adequate gas cushion in the distributing container sufficient for the dispensing of the liquid quantity in said container in the case of correct handling.

For pressure-dependent liquid dosing the filling device can be equipped with a second control valve, which preferably operates in a pressure-dependent manner. The control valve preferably has two feed lines, namely a liquid feed line from the dosing container, a gas filling line branched from the gas-carrying area of the system, and a discharge line, namely a filling line which passes the particular medium to the filling connection. In order to keep the gas filling line at a lower pressure level during the filling process compared with the remaining gas carrying systems, in a branch or in the gas filling line there is preferably a pressure regulator or reducer, which ensures the desired lower pressure level. The pressure-dependent control of the second control valve can be carried out with the aid of the pressure difference between the gas pressure in the gas filling line and the liquid or gas pressure in the filling line from the control valve to the filling connection and in the case of a relative overpressure in the gas filling line preferably the path for the filling with pressurized gas is opened and when there is a pressure compensation preferably the path for the filling with liquid is opened. The switching position for the liquid filling in the case of pressure compensation can be achieved by a mechanical pretension acting on the control member.

Further features of the invention can be gathered from the following description of preferred embodiments in conjunction with the subclaims and drawings. Individual features can be implemented individually or in combination in an embodiment of the invention. In the drawings show:

FIG. 1 An embodiment of the invention for a volume-dosed filling of distributing containers.

Figure 2:
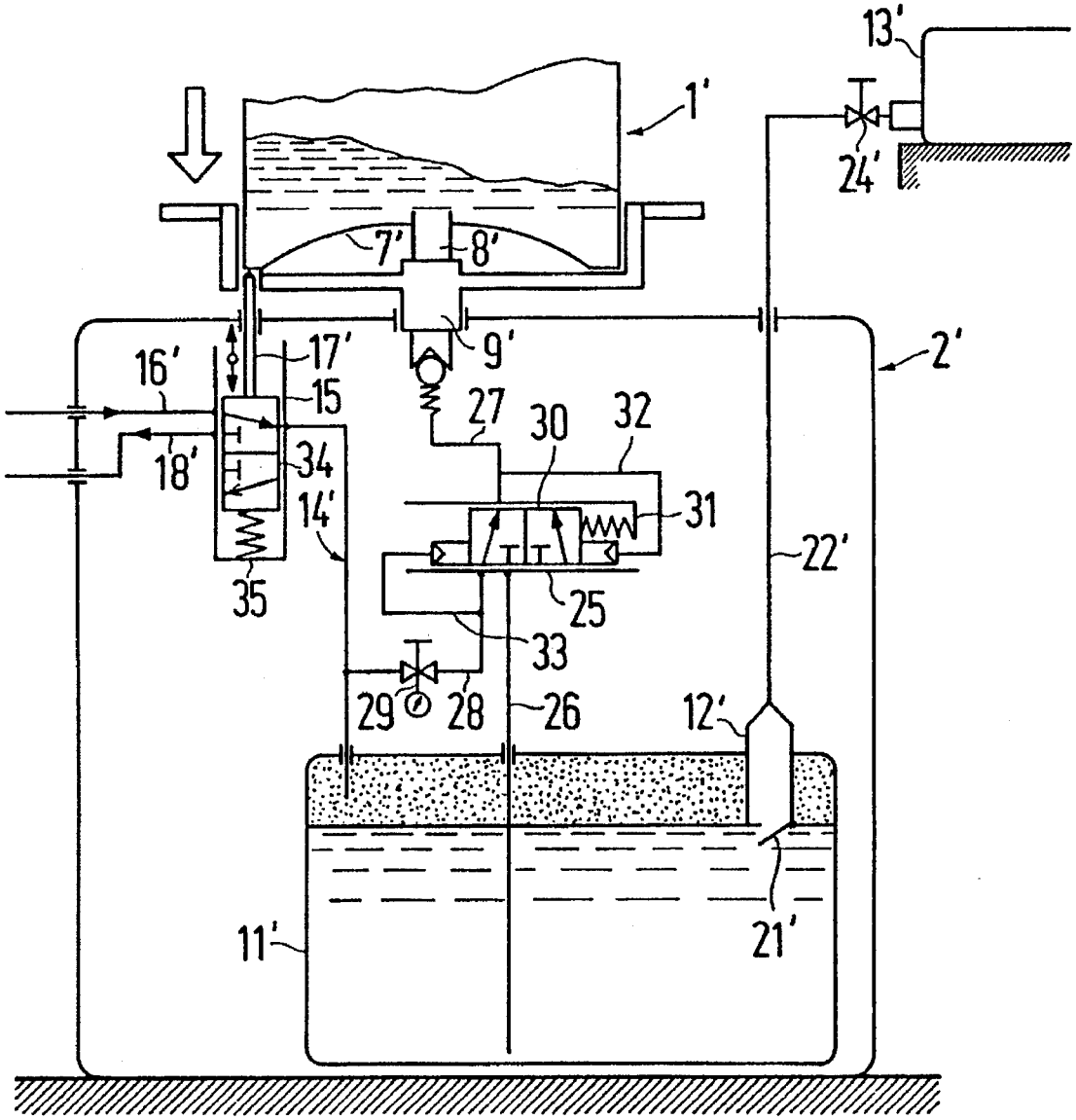

FIG. 2 An embodiment of the invention for a pressure-dependent liquid filling of a distributing container.

Figure 3:
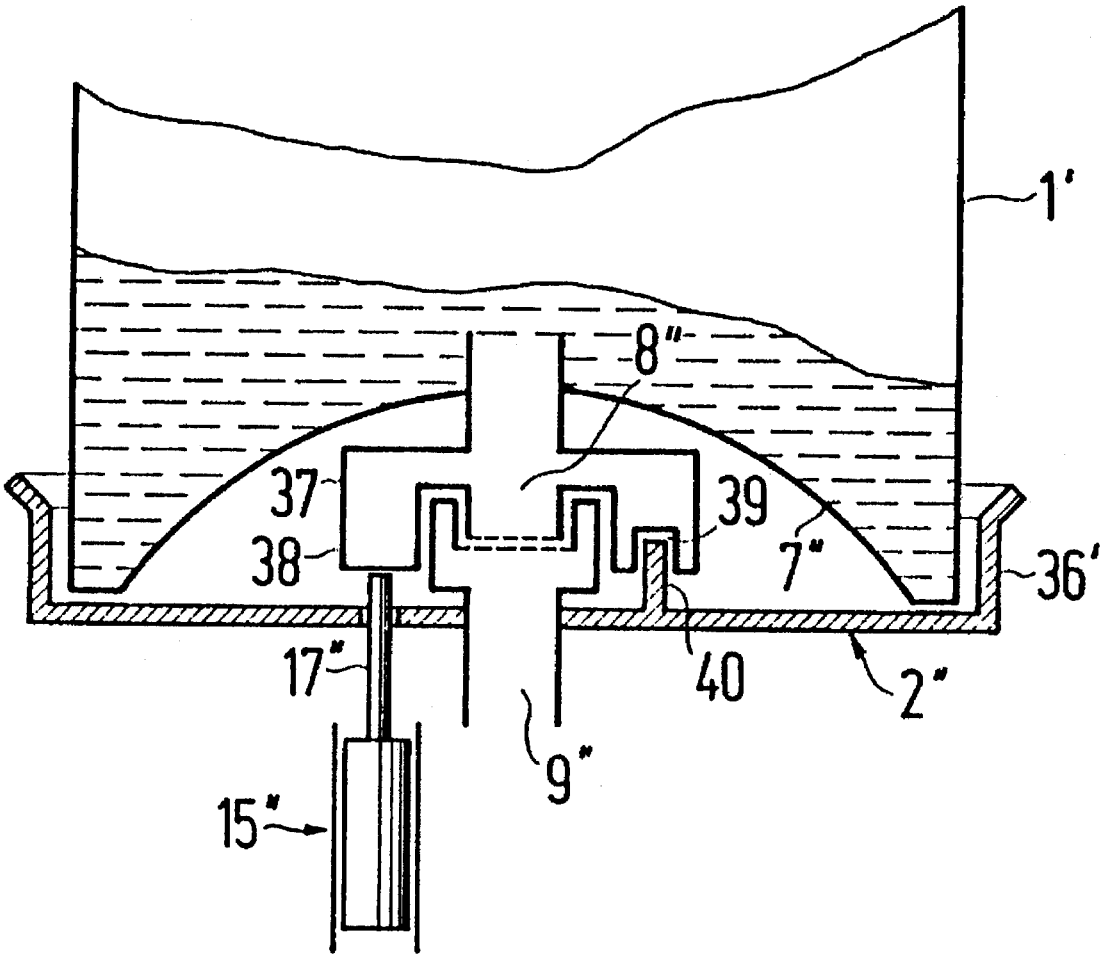

FIG. 3 An embodiment of the invention with mechanical coding between the distributing container and the filling device.

Figure 4:
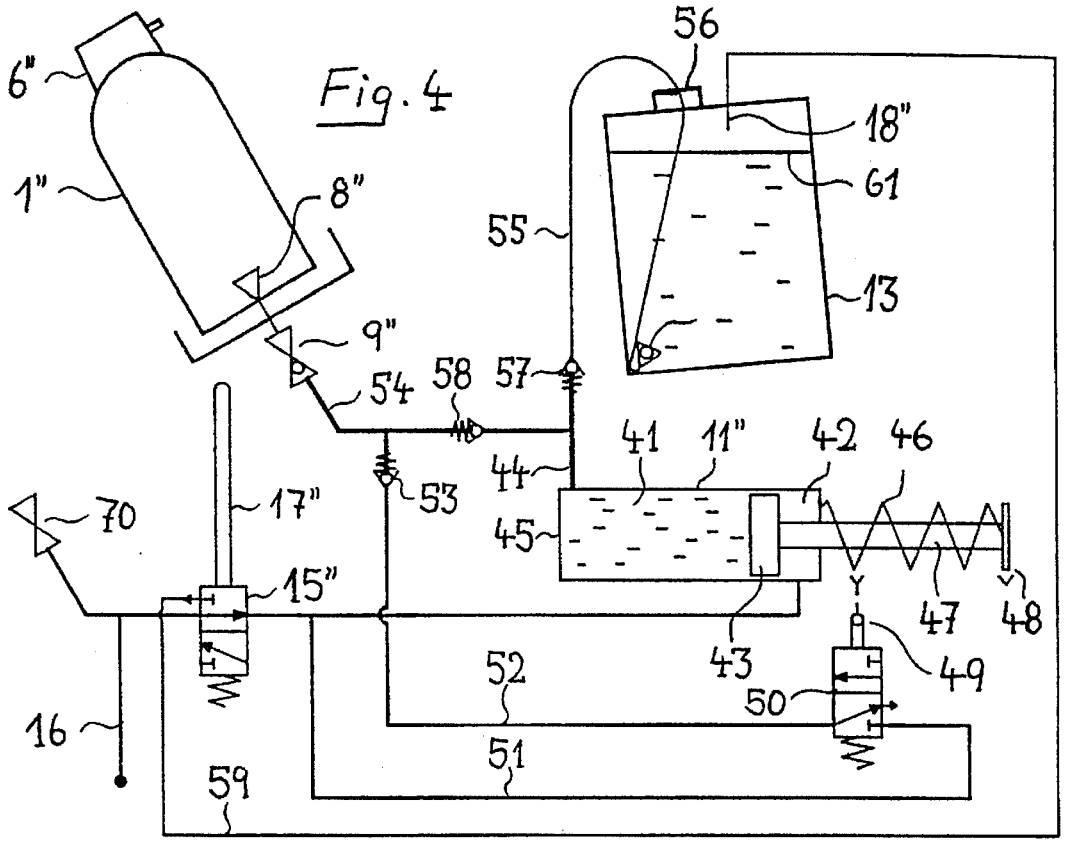

FIG. 4 An embodiment of the invention for a volume-dosed filling of distributing containers with a partition between the liquid chamber and the gas chamber in the dosing container constructed as a pump.

Figure 5:
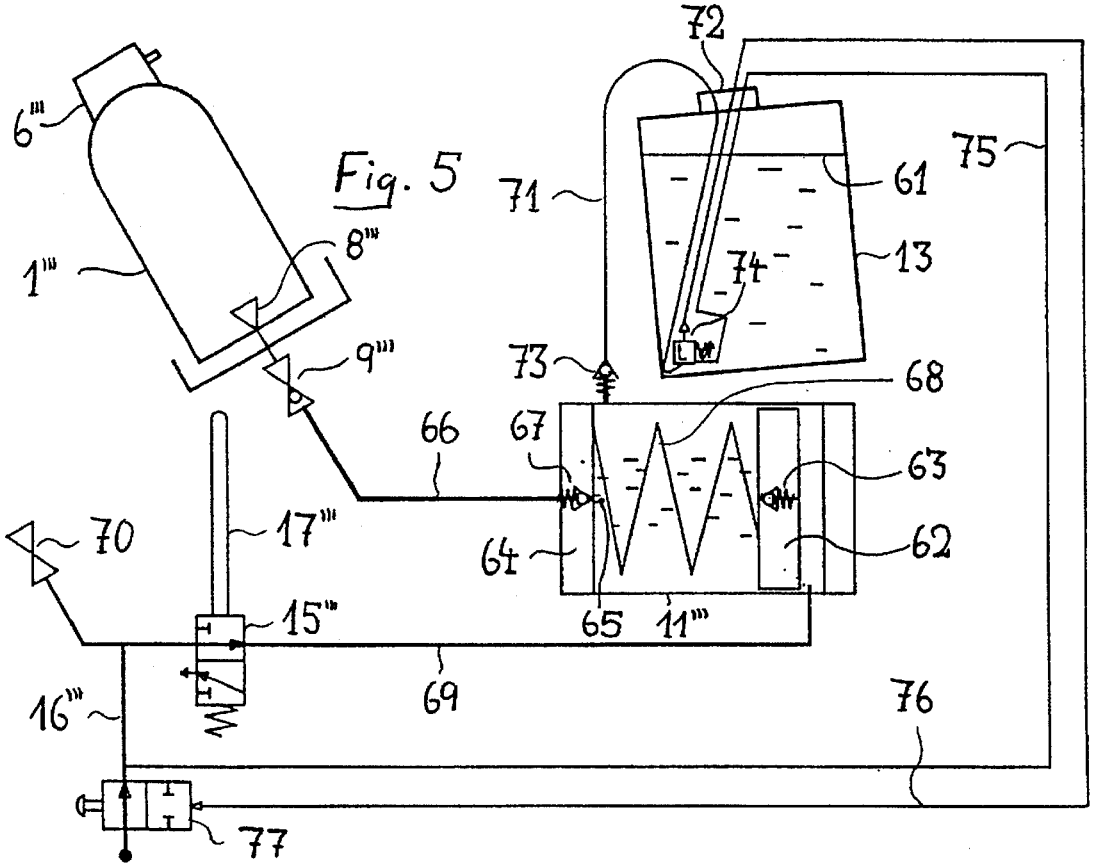

FIG. 5 A modification and extension of the embodiment of FIG. 4.

FIG. 1 shows a refillable can 1 in conjunction with a filling device 2. The can 1 is made essentially from metal, particularly aluminium, and is constructed as a pressurized can for dispensing, delivering or distributing a liquid content, particularly by spraying. It has a cylindrical casing or jacket 3 and is non-detachably connected on its top 4 to a clipped-on distributing or delivery valve 5, which is operable by depressing a spray head 6. The can bottom 7 is constructed in one piece with the jacket 3 and is drawn in in concave manner. In the centre of the can bottom a spring-loaded filling valve 8 is sealingly screwed into the bottom wall and is downwardly openable mechanically and/or by fluid pressure. The part of the filling valve 8 projecting out of the can bottom 7 does not extend to the lower edge of the can bottom, so that the base of the can 1 is not impaired by the valve 8.

The filling device 2 has a filling connection 9 constructed as a distributing valve and which functions as a check valve and whose shape corresponds with that of the valve 8 of the can 1, so that on placing the can on the filling connection 9 the valves on both sides are opened, accompanied by the reciprocal sealing of the connection towards the outside. The filling connection 9 is connected to a liquid pressure line 10, which leads to the bottom of a dosing pressure vessel 11 for the liquid medium to be refilled. The dosing container 11 is provided with a preferably adjustable refilling device 12 acting as a volume dosing device and by means of which the container 11 can be filled with the liquid volume quantity intended for refilling purposes from a storage tank 13 or drum located above the same. The refilling dosing device 12 is constructed as a level-dependent switch and automatically closer after the dosing container has been filled with the predetermined liquid volume in a completely sealed manner, particularly after a pressurized gas has acted on the dosing container.

The dosing container 11 is closed on all sides and is connected in the upper area to a gas feed line 14 through which the pressurized gas can be introduced over the free surface of the liquid volume, which only takes up roughly one third of the dosing container volume. The line 14 is connected by means of a three-way valve 15 to a pressurized gas supply line 16, which is connectable to a pressure pump and in which either the pressure pump and/or the pressurized gas supply line 16 is provided with a not shown pressure regulator and/or with an overpressure valve in order to upwardly limit or keep substantially constant the gas pressure in the line 16. A usable maximum pressure in the complete system is e.g. approx. 6 bar and the can 1 is also designed for this operating pressure.

The multiway valve 15 is constructed as a mechanical control valve and is operable by a feeler 17, which can be pressed down by the placing of the can 1 on the filling connection 9 and thereby connects the pressurized gas line 14 to the pressurized gas supply line 16. On raising the can this connection is separated again and simultaneously by reversing the three-way valve 15 the gas feed line 14 is connected to a vent or exhausting outlet 18, i.e. opened to the outside.

When there is a free passage from the pressurized gas supply line 16 to the gas feed line 14 through the opened valve 15 a gas cushion is built up in the dosing container above the predetermined liquid volume, e.g. with a pressure of 6 bar. When the valves 8 and 9 are simultaneously opened, the pressurized gas cushion in the dosing container 11 forces the predetermined liquid volume out of the same and through the line 10 from below and through the valves 9 and 8 into the can 1 and the gas then automatically flows until in the can there is the same pressure as in the pressurized gas supply line 16, i.e. e.g. 6 bar. The can 1 is then filled up to a predetermined level 19 with the liquid medium and above it is a pressurized gas cushion used for expelling the liquid medium.

By removing the can 1 from the filling connection 9 the filling valves 8 and 9 are closed. Simultaneously, by relieving the feeler 17, the three-way valve 15 is reversed, so that the gas feed line 14 is separated from the gas supply line 16 and connected to the vent opening 18. Thus, the gas pressure in the gas feed line 14 and in the dosing container 11 drops to ambient pressure, so that the hydrostatic pressure of the liquid column 20 of the liquid supply comes into action in the drum 13 positioned above the dosing container 11, a float valve 21 of the volume dosing device 12 opens and once again the predetermined liquid volume can flow into the dosing container 11. A new refilling process can be initiated by mounting a further can 1 on the filling connection 9, accompanied by the operation of the feeler 17.

The feeler 17, whose operating direction is parallel to that of the valves 8 and 9, is so constructed and/or set that on engaging the can it responds before the valves 8 and 9 and on removing the can later than said valves. Thus, the gas pressure in the dosing container 11 is built up before the valves 8 and 9 open and is then decreased again if the valves 8 and 9 are reclosed following the removal of the can.

The refilling device 12 can in simple manner be constructed in that a refilling line 22 leading from the drum 13 into the dosing container 11 projects into the latter and at least the lower end 23 of the refilling line 22 is height-adjustable. The valve 21 at the lower end 23 of the refilling line 22 is so constructed that it responds to the rising liquid level in the dosing container and closes if the liquid level reaches the lower end 23 of the refilling line 22.

The refilling line 22 is also provided with a mechanical stop valve, which is provided for the permanent closure of the refilling line 22, e.g. on disassembling the filling device 2 or for cleaning purposes.

The embodiment according to FIG. 2 operates according to a similar principle to the embodiment of FIG. 1, i.e. both liquid and pressurized gas are conveyed by a single valve into the distributing container. Therefore comparable parts are given corresponding reference numerals. However, an important difference is that unlike in the embodiment of FIG. 1 where firstly the liquid and then the pressurized gas are dosed into the distributing container, conversely firstly the pressurized gas and then the liquid are dosed into the distributing container. The aerosol nozzle 1' serving as the distributing container is constructed in the same way as in the embodiment of FIG. 1. It is therefore only partly shown. The filling connection 9', pressure line 10', dosing container 11', refilling device 12', storage tank 13', pressurized gas line 14', mechanical multiway valve 15', pressurized gas supply line 16', feeler 17', multiway valve 15', vent line 18', float valve 21', refilling line 22' and mechanical stop valve 24' are correspondingly constructed, but are diagrammatically represented. The dosing container 11' can have a larger volume, particularly liquid volume, because, as mentioned hereinbefore, the liquid is delivered in pressure-dosed and not volume-dosed manner from the dosing container in this embodiment. In principle, with the filling device of this embodiment delivery or distributing containers 1' of different sizes can be filled.

Unlike in the embodiment according to FIG. 1 the pressure line leading from the dosing container 11' to the filling connection 9' is not constructed in through manner, but is instead broken by means of a pressure switch 25 into two portions 26, 27, the portion 26 being located between the dosing container 11' and the pressure switch 25 and the portion 27 between the pressure switch 25 and the filling connection 9. From the gas feed line 14 leading from the multiway valve 15' in the gas chamber of the dosing container 11' is branched off a gas dosing line 28, which leads to the pressure switch 25 as a second inlet and in which is located a pressure regulator 29 operating as a pressure reducer.

In the pressure switch 25 is located a control slide valve 30, which links the liquid line 26 or gas dosing line 28 with the line portion 27 serving as the filling line. The control slide valve 30 is pretensioned with a compression spring 31 in the direction of a slide valve position in which the liquid line 26 is connected with the filling line 27 to the control slide valve 30. In addition, a control line 32 leads from the filling line 27, which in the case of a fluid pressure prevailing therein acts in the same direction as the compression spring 31. On the other side of the control slide valve 30 engages a control line 33, which in the case of a gas pressure prevailing therein exerts a thrust force on the control slide valve 30 in the direction of a connection between the gas dosing line 28 and the filling line 27. The pressure regulator 29 reduces the gas pressure prevailing in the gas dosing line 28 and the control line 33 to max 3 bar, whereas the maximum gas pressure in the remaining gas-carrying system is 6 bar.

In this embodiment the mechanical switch 15' is shown in detail. It is also constructed as a three-way valve and has a feed line, namely the pressurized gas supply line 16' and two drain lines, namely the gas feed line 14' to the dosing container and the vent line 18'. The control valve 15' has a control slide valve 34, which is pretensioned on one side with a compression spring 35 in the direction of the switching position in which the gas-carrying system of the filling device is connected to the vent line 18', i.e. the gas-carrying system is made pressureless. On depressing the feeler 17' of the multiway valve 15' with the aid of the bottom edge of the can 1' or by means of other can parts the control slide valve 34 of the multiway valve 15' is forced into the other operating position, so that the pressurized gas supply line 16' having a pressure of 6 bar is connected to the gas feed line 14'.

In this operating position the filling process is initiated. Pressurized gas flows through the pressurized gas supply line 16', via the multiway valve 15' into the gas feed line 14', via the branch to the gas dosing line 28 through the pressure regulator 20 and from there with a reduced pressure of only 3 bar into the control line 33 and through the control slide valve 30 in the closed position, in which the gas dosing line 28 is connected to the filling line 27. Gas can pass through the opened valves 8' and 9' into the can 1', until there a gas cushion of substantially 3 bar has built up. There is then essentially a pressure balance between the control lines 33 and 32, so that the compression spring 31 moves the control slide valve 30 into the other operating position, in which the liquid line 26 comes into communication with the filling line 27. As a result of the gas pressure of 6 bar, which prevails over the liquid level in the dosing chamber 11', the liquid medium is then dosed from the dosing container 11 into the can 1 and namely in a quantity such that in said can the maximum pressure of 6 bar is reached. The volume-related liquid quantity is dependent on the reception capacity of the can 1. If the can 1 was empty prior to the filling process, then the gas cushion of 3 bar would take up the entire volume of the can 1' and by the subsequently flowing liquid would essentially be compressed to half, so that the can would essentially be half-filled with liquid. However, if there was still residual liquid in the can, then the gas cushion is correspondingly smaller after filling with pressurized gas at 3 bar. Following the pressure-dependent dosing in of liquid with 6 bar this is still sufficient to be able to deliver the entire liquid quantity.

If the can 1' is lifted off following the filling process, then the control slide valve 34 of the mechanical multiway valve 15' moves into the pressure-relieved position, so that the gas-carrying system in the filling device is made pressureless or at ambient pressure. The area of the gas-carrying system at the lower pressure level, namely the gas dosing line 28 and the control line 33 is provided with a pressure maintaining device, so that the residual pressure in these lines is sufficient for sliding back the control slide valve 30 of the pressure switch 25 back into the initial position shown in FIG. 2.

The filling device 2' according to FIG. 2 has a cup-shaped receptacle 36 used for centring the mounted can 1'. This receptacle 36 is simultaneously suitable for sensing the can diameter. Larger diameter cans do not fit into the receptacle and can consequently not be filled. In the case of smaller diameter cans the outer, lower can edge does not extend up to the feeler 17' of the multiway valve 15', so that the filling process cannot be initiated. In this way, to a certain extent, incorrect fillings can be avoided.

The embodiment according to FIG. 3 shows a coding in the form of mechanical fits between the can and the filling device, for completely excluding an incorrect filling. The mechanical coding is preferably provided on the filling valve 8" and the filling connection 9", because there is a substantial degree of freedom regarding the shaping of these two valves and consequently the remaining construction of the can and the filling device need not be influenced. In a preferred embodiment the multiway valve 15" can be incorporated into the mechanical coding, as shown in FIG. 3, which further increases reliability and security. As shown in FIG. 3, the feeler 17" of the mechanical control valve is at such a limited distance from the filling connection 9, that it is neither operable from the outer, lower can edge, nor from the drawn-in can bottom 7'. For the operation of the feeler 17", the filling valve 8" of the can 1" has a mechanical coding element. As shown, this can be in the form of a plate-like widening of the filling valve 8' and can have a widened edge directed in cup-shaped manner away from the can bottom 7'. The downwardly directed edge 38 can on the one hand serve as a pressure member for pressing down the feeler 17" and on the other hand the widened edge 38 can also have holes or recesses 39 in which, in the case of a correct fit, can engage pins or projections 40, which are provided on the filling device receptacle 36'. Through corresponding dimensioning of the size, radial spacing and/or angular position of the pins or projections in the vicinity of the filling connection and the corresponding holes or receptacles in the vicinity of the filling valve, random variants for the mechanical coding are provided. Moreover, the receptacle 36" serving as a centring aid can also determine the can diameter.

The embodiment according to FIG. 4 is a further development of that of FIG. 1. Therefore corresponding parts are given the same reference numerals. The delivery container constructed as a spray can 1" has on filling an inclined position, which facilitates handling. Otherwise the cooperation between the filling valve 8", the filling connection 9" and the operation of the feeler 17" of the multiway valve 15" is the same as in the embodiment according to FIG. 1 or FIG. 2. The coding for avoiding an incorrect operation is also correspondingly constructed.

Unlike in the embodiment according to FIG. 1 the liquid chamber 41 is separated from the gas chamber 42 by a piston 43 constructed as a partition. The movement of the piston in the delivery direction still takes place pneumatically through the gas cushion in the gas chamber 42, so that there is no change with regards to the operation concerning the pressing out of liquid. However, freedom is obtained regarding the dosing container position, so that the bottom 45 having the outlet 44 need not coincide with the lowest point. The piston 43 is provided with a piston rod 47 loaded by a mechanical spring 46, the spring tension being adjusted in such a way that the piston 43 is fetched back in the case of pressure relief and simultaneously a new liquid volume can be sucked out of the storage tank 13". The free end of the piston rod has a mechanical stop 48, which cooperates with a control element 49 of a control valve 50, if the piston 43 has reached the bottom 45, i.e. the liquid volume has been pressed out. In the control valve the passage is then freed for the pressurized gas from a gas feed line 51 coming from the multiway valve 15" and passes through a pressurized gas line 52, via a check valve 53 into the filling line 54, which leads to the filling connection 9".

If, after the filling of the distributing container 1" and the removal thereof, there is a closing of the pressurized gas supply and a pressure relief in the gas system through the operation of the multiway valve 15, then the piston 43 is moved back due to the spring tension of the spring 46, so that the control element 49 is again released by the mechanical stop 48 of the piston rod, so that the pressure-loaded control valve 50 again passes into its starting position in which the pressurized gas supply is interrupted. As a result of the mechanical moving back of the piston 49 simultaneously liquid medium is sucked from the storage tank 13" by means of a liquid suction line 55. As a result of the underpressure the liquid suction line can be introduced from above via a lid 26 of the storage tank 13" into the latter. A check valve 57 permits a problem-free suction of liquid from the storage tank and prevents a return flow of liquid on pressing out the liquid volume into the distributing container 1". Conversely a check valve 58 in the filling line 54 leading from the dosing container 11" to the filling connection 9" prevents a suction of gas or liquid from the filling line for as long as there is a relative underpressure in the dosing container 11".

The gas outlet 18" does not lead into the open and instead issues into the storage tank 13". For this purpose between the multiway valve 15" and the vent 18" there is a vent line 59, which is connected to the vent of the multiway valve 15.

On the bottom of the storage tank 13" at the suction opening of the liquid suction line 55 there is a float valve 60, which closes the suction opening of the liquid suction line 55 if the liquid level 61 in the storage tank 13" drops below a predetermined point, i.e. if the tank 13" is empty. The float valve 60 remains closed if the suction line, by removing the lid, is removed together with the latter from the storage tank 13" and then opens again when it has been brought below the liquid level 61.

In the embodiment of FIG. 5 the dosing in of the liquid volume and the pressurized gas takes place through the dosing container 11''', although in the latter there is a separation between the liquid chamber 41 and the gas chamber 42 by means of a piston 62. In order to permit a passage of pressurized gas through the dosing container 11''', the piston 62 has a passage equipped with a check valve 63, the latter being closed for as long as there is still liquid in the dosing container 11'''. On the bottom 64 of the dosing container 11''' is provided a stop 65, which cooperates with the check valve 63 as soon as the piston 62 has reached the bottom 64. Through the stop the check valve 63 is mechanically opened, so that the pressurized gas acting on the back of the piston 62 can be brought via the latter into the liquid chamber of the dosing container 11''' reduced to a minimum size and from same it flows via a pressure line 66 leading from the bottom 64 of the dosing container to the filling connection 9'''. In the bottom 64 of the dosing container 11''' on the step of the pressure line 66 is advantageously provided a further check valve 67, which blocks in the opposite direction to the check valve 63 in the piston 62. The stop 65 is advantageously located on the check valve 67 and is constructed as an extension of the pressure line 66 in the dosing container 11'''. Thus, the check valve 63 of the piston 64 cooperate in much the same way a plug-in coupling like the filling valve 8''' and filling connection 9''' between the filling device and the distributing container 1'''.

For the return of the piston 62 there is once again a return spring 68, which on this occasion is located within the liquid chamber of the dosing container 11''' and is supported on the one hand on the container bottom 64 and on the other on the piston 62 and in the case of a pressure relief in the gas feed line 64 forces back the piston 62 into the starting position. Before reaching the multiway valve 15''', there is a delivery valve 70 from the gas pressure line 16''' in the same way as in the embodiment according to FIG. 4 and is used for the exclusive delivery of compressed air. Independently of its coding each distributing container 1''' can be connected to the compressed air delivery valve 70. In this way the distributing containers 1''' can be filled via said valve with compressed air, if the gas pressure in the distributing container 1''' has dropped, e.g. due to an incorrect operation and without the liquid being delivered. Also an exclusive filling of an empty distributing container 1''' with compressed air is possible, if desired, via said valve.

The liquid suction line 71 leading from the storage tank 13''' to the liquid chamber of the dosing container 11''' once again extends from the bottom of the tank 13''', via a lid 72 thereof and passes via a check valve 73 in the vicinity of the container bottom 64 into the liquid chamber of the dosing container 11'''. In the same way as the check valve 57 of the embodiment according to FIG. 4, the check valve 73 on returning the piston to its starting position is opened by suction due to the relatively reduced pressure, so that liquid can flow in from the storage tank. If pressurized gas acts on the back of the piston 62, then the check valve prevents a return flow of liquid to be dosed in.

The suction end of the liquid suction line is once again provided with a float valve 74, which prevents a sucking in of air from the emptied storage tank 13'''. The float valve 74 is simultaneously constructed as a control valve, which is located in a gas pressure line and whose inlets and outlets 75, 76 also pass through the container lid 72 to the bottom of the tank 13'''. The inlet of the gas pressure line 75 is constantly connected to the pressurized gas line 16'''. The outlet 76 leads to a master switch 77 located in the pressurized gas line 16''' and shuts off the compressed air supply in the latter if the float valve 74 in the storage tank 13''' opens the passage between the inlet 75 and the outlet 76 of the pressurized gas line. With the aid of said master switch 77 the further use of the filling device is prevented if the storage tank 13''' is empty. Following the removal of the final distributing container 1''', the system is rendered pressureless via the control element 17''' and the multiway valve 15''', after which, due to the disconnection of the master switch 77, no further pressurized gas can pass into the system. The float valve 74 can have a float constructed as a piston and which is guided in a vertical, cylindrical sleeve and in its upper stop position frees the suction opening for the liquid suction line and simultaneously closes the horizontal passage between the inlet 75 and the outlet 76. If the liquid level 61 comes into the vicinity of the float valve 74, then the float drops, the suction opening of the liquid suction line 71 being closed and simultaneously the passage between the lines 75 and 76 opened. The lid 72 of the liquid storage tank 17''' is once again preferably provided with a coding, which cooperates with the opening of the tank 13''', so that there is no possibility of incorrect operation due to the wrong container content and wrong container size.

We claim:

1. A refillable distributing container (1, 1', 1") for a liquid medium comprising:

a container;

a distributing valve (5) disposed in an upper portion of the container; said distributing valve being constructed exclusively for distributing the liquid medium from the container;

a filling valve (8, 8', 8") on the container being constructed for filling the container (1, 1', 1") both with the liquid medium and with pressurized gas from a filling device (2, 2', 2");

the filling device having a filling connection (9, 9', 9") constructed as a valve openable by the filling valve (8, 8', 8") and a separate control valve for controlling the flow of media to the filling connection (9, 9', 9");

the container having a surface portion which is constructed as an operating member for operating the control valve (15, 15', 15") of the filling device;

the operating member being provided with a mechanical coding structure (37) for indicating at least one of the nature of the liquid medium to be filled into the container and the volume of the distributing container, the mechanical coding structure corresponding to a corresponding coding structure (17", 40) of a filling device providing at least one of the liquid medium and the volume indicated by the mechanical coding structure of the operating member for ensuring that, from a plurality of distributing containers each having different mechanical coding structures, only a distributing container with the corresponding mechanical coding structure can be filled by the filling device and that distributing containers having non-corresponding mechanical coding structure are prevented from being filled by the filling device.

2. The distributing container according to claim 1, wherein the filling valve (9) is interchangeably fixed to the container (1).

3. The distributing container according to claim 1, wherein, apart from the distributing valve (5) and the filling valve (8), the container has no further openings and no further valves.

4. A filling device for refilling a distributing container having a distributing valve (5) disposed in an upper portion of the container; said distributing valve being constructed exclusively for distributing the liquid medium from the container; a filling valve (8, 8', 8") on the container being constructed for filling the container (1, 1', 1") both with the liquid medium and with pressurized gas from the filling device (2, 2', 2"); the container having a surface portion which is constructed as an operating member for operating the control valve (15, 15', 15") of the filling device; the operating member being provided with a mechanical coding structure (37) for indicating at least one of the nature of the liquid medium to be filled into the container and the volume of the distributing container, said filling device comprising:

a filling connection (9);

a dosing container (11) for receiving and distributing liquid medium, a filling line (10) leading from one of the group consisting of an outlet and a bottom of the dosing container (11) to the filling connection (9) of the filling device, the filling connection being constructed as a valve which is connectable with the filling valve (8) of the distributing container (1); the filling device further comprising a pressurized gas device (14, 15, 16) connectable to the dosing container (11) for pressing a quantity of the liquid medium out of the dosing container and pressing the quantity into the distributing container (1) and for building up a pressurized gas cushion in the distributing container (1), the filling device further comprising a coding structure (17", 40) adapted to cooperate with a mechanical coding structure (37) of the distributing container for sensing information about at least one of the nature of the medium to be filled into the distributing container and the volume of the distributing container, said information being coded in the mechanical coding structure (37) of the distributing container.

5. A filling device for refilling distributing containers having a filling valve for filling the distributing containers with liquid medium and pressurized gas, the filling device comprising:

a dosing container (11) for receiving and distributing liquid medium, a filling line (10) leading from one of the group consisting of an outlet and a bottom of the dosing container (11) to a filling connection (9) of the filling device, the filling connection being constructed as a valve which is connectable with a filling valve (8) of the distributing container (1), the filling device further comprising a pressurized gas device (14, 15, 16) connectable with the dosing container (11) for pressing a quantity of the liquid medium out of the dosing container and pressing the quantity into the distributing container (1) and for building up a pressurized gas cushion in the distributing container (1), the dosing container containing a volume filled with the liquid medium and a volume filled with gas, the volume filled with gas being connectable through a gas line to the environment via a pressure compensating valve (15, 18) in the gas line.

6. A filling device according to claim 5, wherein the pressure compensating valve is operable by the distributing container (1) to be filled.

7. A filling device according to claim 5, wherein the pressure compensating valve is a multiway valve operating as a control valve.

8. A filling device for refilling a distributing container having a filling valve for filling the distributing container with liquid medium and pressurized gas, the filling device comprising a dosing container (11) for receiving and distributing liquid medium, a filling line (10) leading from one of the group consisting of an outlet and a bottom of the dosing container (11) to a filling connection (9) of the filling device, the filling connection being constructed as a valve which is connectable with the filling valve (8) of the distributing container (1), the filling device further comprising a pressurized gas device (14, 15, 16) connectable with the dosing container (11) for pressing a quantity of the liquid medium out of the dosing container and pressing the quantity into the distributing container (1) and for building up a pressurized gas cushion in the distributing container (1), the dosing container (11, 11", 11''') being constructed as a pneumatic dosing pump with a liquid chamber (41) for receiving the liquid medium and a gas chamber (42) for receiving gas, the liquid chamber (41) and the gas chamber (42) of the dosing container (11", 11''') being separated from one another by a movable, at least temporarily sealing partition (43, 62) which modifies the relative sizes of the liquid chamber (41) and the gas chamber (42).

9. The filling device according to claim 8, wherein the dosing container (11", 11"') is formed by a cylinder serving as a dosing chamber and in which is displaceably mounted a piston (43, 62).

10. The filling device according to claim 8, wherein the partition (43, 62) is movable by gas pressure in the direction towards one of the group consisting of the outlet and the bottom (45, 64) of the dosing container (11", 11"') accompanied by a size reduction of the liquid chamber (41) of the dosing container (11", 11"').

11. The filling device according to claim 10, further comprising a spring positioned to reset the position.

12. The filling device according to claim 8, wherein the dosing container (11", 11"') is constructed as a suction pump for drawing the liquid quantity from a storage tank (13", 13"').

13. The filling device according to claim 8, further comprising a supply line and a control valve and wherein the partition (43, 62) is connected to an operating member (48, 65) which, on reaching one of the group consisting of the outlet and the bottom (45, 64), opens the control valve (50, 63) for opening the supply line (54, 66) leading to the filling connection for supplying pressurized gas into the distributing container (1", 1"').

14. The filling device according to claim 13, wherein the control valve (63) is located in the dosing container (11"').

15. The filling device according to claim 13 wherein the control valve (63) is closed for as long as there is still liquid medium in the dosing container (11).

16. The filling device according to claim 15, wherein, on the bottom (64) of the dosing container (11), the operating member (65) cooperates with the control valve (63) as soon as the piston (62) has reached the bottom (64).

17. The filling device according to claim 16, wherein, by the operating member, the control valve (63) is mechanically opened so that the pressurized gas can be brought, via a pressure line (66) leading to the bottom (64) of the dosing container (11), to the filling connection (9).

18. A filling device for refilling a distributing container having a filling valve for filling the distributing container with liquid medium and pressurized gas, the filling device comprising a dosing container (11) for receiving and distributing liquid medium, a filling line (10) leading from one of the group consisting of an outlet and a bottom of the dosing container (11) to a filling connection (9) of the filling device, the filling connection being constructed as a valve which is connectable with the filling valve (8) of the distributing container (1), the filling device further comprising a pressurized gas device (14), 15, 16) connectable with the dosing container (11) for pressing a quantity of the liquid medium out of the dosing container and pressing the quantity into the distributing container (1) and for building up a pressurized gas cushion in the distributing container (1), the pressurized gas device (14, 15, 16) having a pressurized gas feed line (14) issuing into the dosing container (11), and which is connectable by means of a mechanical control valve (15) to a pressurized gas source, the control valve (15) being adapted to be operable by the container (1) to be filled, the dosing container (11) being fillable with pressurized gas on operating the control valve (15) with the container (1).

19. The filling device according to claim 18, wherein the gas feed line (14) is equipped with a multiway valve (15), which operates both as a control valve and as a pressure compensating valve.

20. The filling device according to claim 19, wherein the multiway valve is a three-way valve.

21. The filling device according to claim 19, wherein at least one of the mechanical control valve and the pressure compensating valve has a mechanical control element (17, 17', 17"), which is operable by an operating member (37, 38) of the filling valve.

22. The filling device according to claim 21, wherein the mechanical control element (17") is so close to the filling connection, that it cannot be reached either from a lower container edge, or from a drawn-in container bottom (7").

23. The filling device according to claim 18, wherein the mechanical control valve (15, 15') is prestressed to switch into a switching position with the opening of the pressure compensating valve (18, 18').

24. The filling device according to claim 18, wherein at least one of the filling pressure and the predetermined liquid volume to be dosed in is adjustable.

25. The filling device according to claim 18, further comprising a refilling device (12) for the filling of the dosing container, the refilling device being connected in fluid communication to the dosing container.

26. The filling device according to claim 25, wherein the refilling device (12) and the dosing container form a volume dosing device and the liquid quantity is a predetermined liquid volume.

27. The filling device according to claim 25, wherein the refilling device (12) is adjustable for modifying the liquid quantity to be dosed in.

28. The filling device according to claim 18, wherein a liquid storage tank (13) is provided and has a feed line issuing into the dosing container (11).

29. The filling device according to claim 18, wherein a check valve (58, 67) is located in the filling line (54, 66) between the dosing container (11", 11"') and the distributing valve (9", 9"').

30. The filling device according to claim 18, wherein a check valve (53, 67) is located in the gas line between the pressurized gas control valve (50, 63) and a distributing valve (9", 9"').

31. The filling device according to claim 30, wherein the check valve (67) in the gas line is identical to the check valve (67) of the liquid line.

32. A process for refilling refillable distributing containers for liquid media, each of the distributing containers comprising a distributing valve being disposed in an upper portion of the container; said distributing valve being constructed exclusively for distributing the liquid medium from the container; and a filling valve being constructed for filling the container both with the liquid medium and with pressurized gas from a filling device, the process comprising the steps of:

filling the distributing container with a liquid medium through the filling valve differing from the distributing valve;

subjecting the distributing container to the action of a pressurized gas, which is substantially not soluble in the liquid medium, the steps of filling and subjecting to gas action being performed with the aid of a filling device, the filling device comprising a dosing container (11) for receiving and distributing liquid media, a filling line (10) leading from one of the group consisting of an outlet and a bottom of the dosing container (11) to a filling connection (9) of the filling device, the filling connection being constructed as a valve which is connectable with a filling valve (8) of the distributing container (1), the filling device further comprising a pressurized gas device (14, 15, 16) connectable with the dosing container (11) for pressing a quantity of the liquid medium out of the dosing container and pressing the quantity into the distributing container (1) and for building up a pressurized gas cushion in the distributing container (1), wherein in the process, the liquid medium and the pressurized gas are successively forced in through the same valve, and wherein the liquid medium is added in volume-dosed manner.

33. The process according to claim 32, wherein the pressurized gas is dosed in pressure-dependent manner.

34. The process according to claim 32, wherein the liquid medium and the pressurized gas are forced in successively and substantially without any interruption of the filling process.

35. The process according to claim 32, wherein the liquid medium is forced into the container by the pressurized gas.

36. The process according to claim 32, wherein the filling process is ended automatically on reaching a predetermined operating pressure in the filling connection.

37. The process according to claim 32, wherein the operation of valves provided for filling purposes is initiated exclusively by engaging the distribution container on a filling connection.

38. The process according to claim 32, wherein initially the liquid medium and then the pressurized gas are dosed in through the filling valve of the distribution container.

* * * * *